US009010970B2

(12) United States Patent
Guercio et al.

(10) Patent No.: US 9,010,970 B2
(45) Date of Patent: Apr. 21, 2015

(54) LIGHT FIXTURE WITH PERIPHERAL COOLING CHANNELS

(71) Applicant: RAB Lighting Inc., Northvale, NJ (US)

(72) Inventors: Vincenzo Guercio, Wallkill, NY (US); Jiang Hu, Shanghai (CN)

(73) Assignee: RAB Lighting Inc., Northvale, NJ (US)

( * ) Notice: Subject to any disclaimer, the term of this patent is extended or adjusted under 35 U.S.C. 154(b) by 368 days.

(21) Appl. No.: 13/647,726

(22) Filed: Oct. 9, 2012

(65) Prior Publication Data

US 2013/0088882 A1 Apr. 11, 2013

Related U.S. Application Data

(60) Provisional application No. 61/545,307, filed on Oct. 10, 2011.

(51) Int. Cl.

| | |
|---|---|
| ***F21V 29/00*** | (2006.01) |
| ***F21V 23/00*** | (2006.01) |
| *F21V 21/30* | (2006.01) |
| *F21Y 101/02* | (2006.01) |

(52) U.S. Cl.

CPC ..... *F21V 29/004* (2013.01); *F21V 21/30* (2013.01); *F21V 23/007* (2013.01); *F21Y 2101/02* (2013.01); *F21V 29/507* (2015.01); *F21V 29/77* (2015.01); *F21V 29/83* (2015.01); *F21V 29/89* (2015.01)

(58) Field of Classification Search

None

See application file for complete search history.

(56) References Cited

U.S. PATENT DOCUMENTS

| | | | |
|---|---|---|---|
| D319,891 | S | 9/1991 | Giese |
| D360,962 | S | 8/1995 | Cornell |
| D407,836 | S | 4/1999 | Leen |
| D437,958 | S | 2/2001 | Doron, Jr. et al. |
| 6,527,422 | B1 | 3/2003 | Hutchison |
| D545,472 | S | 6/2007 | Guercio |
| D552,778 | S | 10/2007 | Butler |
| D556,935 | S | 12/2007 | Quioque et al. |
| D573,288 | S | 7/2008 | Xu et al. |
| 7,434,959 | B1 | 10/2008 | Wang |
| 7,458,706 | B1 | 12/2008 | Liu et al. |
| D596,765 | S | 7/2009 | Chiu |
| 7,637,636 | B2 | 12/2009 | Zheng |
| D614,336 | S | 4/2010 | Zheng et al. |
| 7,819,556 | B2 | 10/2010 | Heffington et al. |
| 7,832,898 | B2 | 11/2010 | Li |

(Continued)

FOREIGN PATENT DOCUMENTS

CN 201582666 9/2010

OTHER PUBLICATIONS

Philips, The art of superior LED luminaire design, 2011, Union NJ, www.philipsna.com.

(Continued)

*Primary Examiner* — Elmito Breval

(74) *Attorney, Agent, or Firm* — Kelly J. Smith; Dennis S. Schell; SmithAmundsen LLC

(57) ABSTRACT

An illustrative light fixture includes an emitter housing and airflow cooling channels. The airflow cooling channels are defined in the space between opposite edges of the emitter housing and a rim around the periphery of at least the opposite edges of the emitter housing. The airflow channels are further defined by fins spanning between the rim and opposite edges and spanning across a side of the housing opposite the illumination side.

20 Claims, 7 Drawing Sheets

(56) References Cited

U.S. PATENT DOCUMENTS

| | | | |
|---|---|---|---|
| 7,841,734 | B2 | 11/2010 | Wilcox |
| 7,854,534 | B2 | 12/2010 | Liu |
| 7,874,697 | B2 | 1/2011 | Biebel et al. |
| 7,878,697 | B2 | 2/2011 | Chiang |
| D636,920 | S | 4/2011 | Boissevain |
| 7,959,327 | B2 | 6/2011 | Lai et al. |
| D642,316 | S | 7/2011 | Zheng |
| 7,976,197 | B2 | 7/2011 | Chen |
| D659,280 | S | 5/2012 | Guercio et al. |
| D668,370 | S | 10/2012 | Guercio et al. |
| D672,076 | S | 12/2012 | Guercio et al. |
| D673,320 | S | 12/2012 | Guercio et al. |
| D679,856 | S | 4/2013 | Guercio et al. |
| 2006/0203510 | A1 | 9/2006 | Noh et al. |
| 2008/0266866 | A1 | 10/2008 | Tsai |
| 2009/0103308 | A1 | 4/2009 | Xu et al. |
| 2009/0196037 | A1 | 8/2009 | Xiao et al. |
| 2010/0033971 | A1 | 2/2010 | Lu et al. |
| 2010/0296287 | A1 | 11/2010 | Huang |
| 2010/0328956 | A1 | 12/2010 | Zhang |
| 2011/0018418 | A1 | 1/2011 | Yoo |
| 2011/0110081 | A1 | 5/2011 | Belknap et al. |
| 2013/0322079 | A1 | 12/2013 | Guercio et al. |

OTHER PUBLICATIONS

Lithonia Lighting, ALX LED Luminaires, Brochure, 2010, Acuity Brands Lighting, Inc., Conyers, Georgia, www.Lithonia.com/ALX-LED.

LIGHT FIXTURE WITH PERIPHERAL COOLING CHANNELS

CROSS-REFERENCE TO RELATED APPLICATIONS

This application is a nonprovisional of U.S. Provisional Application No. 61/545,307, filed Oct. 10, 2011, and titled Light Fixture with Peripheral Cooling Channels, which is herein entirely incorporated by reference.

BACKGROUND

The present invention relates to light fixture cooling features, and particularly, to providing a light fixture with external surface features to facilitate cooling.

Managing the temperature of light sources in a light fixture is generally important to performance and longevity. This is particularly true with newer highly efficient lighting technology, for example, light sources such as LEDs or laser diodes. LEDs are generally selected to maximize the light output for a given power consumption at a reasonable cost. Because LED light sources operate at a much lower temperature than typical incandescent light sources, less energy is wasted in the form of heat production. However, LEDs tend to be more sensitive to operating temperature and lower operating temperatures also provide a much smaller temperature difference between the LED and the ambient environment, thus requiring greater attention to thermal management to transfer and dissipate any excess heat generated by the LED driver and emitter so that the design operating temperature for the components are not exceeded.

As temperatures rise, the efficacy of the LED is reduced, reducing the light output, and reducing the lifespan of the LED. LED lighting fixtures generally include both LED drivers and LED emitters. To facilitate dissipation of heat, convection, conduction, and radiation are available modes of heat transfer. For LED light fixtures, dissipation of heat by conduction is often provided by one or more LED packages being mounted on a heat sink. The heatsink is generally integral with or thermally coupled with the light housing, which often includes external cooling fins to further facilitate the dissipation of heat from the light fixture by convection and radiation.

Many prior designs seeking to address these concerns provides a set of fins forming vertical airflow channels extending radially around a light emitter and driver housing; however, the fins forming the airflow channels only abut vertical edges of the housing.

Therefore, it is desirable to provide a lighting fixture design in a unitary fixture that maximizes cooling by thermal convection for the light housing, including convection from horizontal surfaces of the housing, and shields the cooling features from as many viewing angles as practical. Additionally, for some lighting fixture designs, it is also desirable to minimize thermal conduction between emitter and driver housings.

SUMMARY

The present invention may comprise one or more of the features recited in the attached claims, and/or one or more of the following features and combinations thereof.

An illustrative light fixture includes an emitter housing and airflow cooling channels. The airflow cooling channels are defined in the space between opposite edges of the emitter housing and a rim around the periphery of at least the opposite edges of the emitter housing. The airflow channels are further defined by fins spanning between the rim and opposite edges and spanning across a side of the housing opposite the illumination side.

An illustrative embodiment of a light fixture for a light emitter includes an emitter housing; an illumination side of the emitter housing, the light emitter projecting light from the illumination side; an opposite side of the emitter housing, located opposite the illumination side; a first and second edge defined by the emitter housing, each of the first and second edges spanning between the illumination and opposite sides; a first rim positioned along the first edge of the emitter housing and spanning between the illumination and opposite sides; a second rim positioned along the second edge of the emitter housing and spanning between the illumination and opposite sides; and a first plurality of fins spanning between the first edge and the first rim, the first edge and the second edge, the second edge and the second rim, and the first rim and the second rim.

The light fixture can further include a plurality of airflow channels, each of the plurality of airflow channels defined between adjacent ones of the first plurality of fins, each of the plurality of airflow channels open to the illumination side of the emitter housing between the first rim and the first edge, extending across the opposite side of the emitter housing, and open to the illumination side of the emitter housing between the second rim and the second edge.

In one illustrative embodiment, the light fixture further includes a driver housing, the driver housing defining a front surface; and an airflow passage defined by a space between the opposite side of the emitter housing and the front surface of the driver housing; and wherein the first plurality of fins extend through the airflow passage. The light fixture can further include a second plurality of fins defined by the driver housing. The first plurality of fins and the second plurality of fins can form a plurality of coplanar fins surfaces.

A plane formed across the first rim and the second rim can optionally not be intersected by the first plurality of fins. A plane formed across the first rim and the second rim can optionally not be intersected by the first edge or the second edge. The first plurality of fins can be in thermal conductivity with the light emitter.

The first rim and the second rim can be on opposite sides of the emitter housing. The first plurality of fins can be parallel with one another. The first plurality of fins can be evenly spaced. The light fixture can further include a top surface defined by the emitter housing, and the top edges of the first plurality of fins can be coplanar with the top surface of the emitter housing.

Another illustrative embodiment of a light fixture for a light emitter includes an emitter housing; an illumination side of the emitter housing, the light emitter projecting light from the illumination side; an opposite side of the emitter housing, located opposite the illumination side; a first and second edge defined by the emitter housing between the illumination and opposite sides; a first rim positioned along the first edge of the emitter housing; a second rim positioned along the second edge of the emitter housing; and a first plurality of fins spanning between the first edge and the first rim, across the opposite side of the emitter housing, and between the second edge and the second rim.

In one illustrative embodiment, the light fixture further includes a driver housing, the driver housing defining a front surface; and an airflow passage defined by a space between the opposite side of the emitter housing and the front surface of the driver housing; and wherein the first plurality of fins extend through the airflow passage. The light fixture can further include a second plurality of fins defined by the driver housing. The first plurality of fins and the second plurality of fins can form a plurality of coplanar fins surfaces.

Another illustrative embodiment of a light fixture for a light emitter, includes a first housing; an illumination side of the first housing, the light emitter projecting light from the illumination side; an opposite side of the first housing, located opposite the illumination side; a first and second edge defined by the first housing between the illumination and opposite sides; a rim extending around at least two opposite edges of the first housing; a first plurality of fins spanning between the rim and the at least two opposite edges of the housing and across the opposite side of the first housing; and a plurality of airflow channels, each of the plurality of airflow channels defined between adjacent ones of the first plurality of fins, each of the plurality of airflow channels open to the illumination side of the first housing between the rim and a first one of the at least two opposite edges of the first housing, extending across the opposite side of the first housing, and open to the illumination side of the housing between the rim and a second one of the at least two opposite edges of the first housing.

In on illustrative embodiment the light fixture further includes a second housing, the second housing defining a front surface; and an airflow passage defined by a space between the opposite side of the first housing and the front surface of the second housing; and wherein the first plurality of fins extend through the airflow passage. The light fixture can further include a second plurality of fins defined by the second housing. The first plurality of fins and the second plurality of fins can form a plurality of coplanar fins surfaces.

Additional features of the disclosure will become apparent to those skilled in the art upon consideration of the following detailed description of the illustrative embodiment.

BRIEF DESCRIPTION OF THE DRAWINGS

The detailed description particularly refers to the accompanying figures in which.

DESCRIPTION OF THE ILLUSTRATIVE EMBODIMENTS

Figure 1:
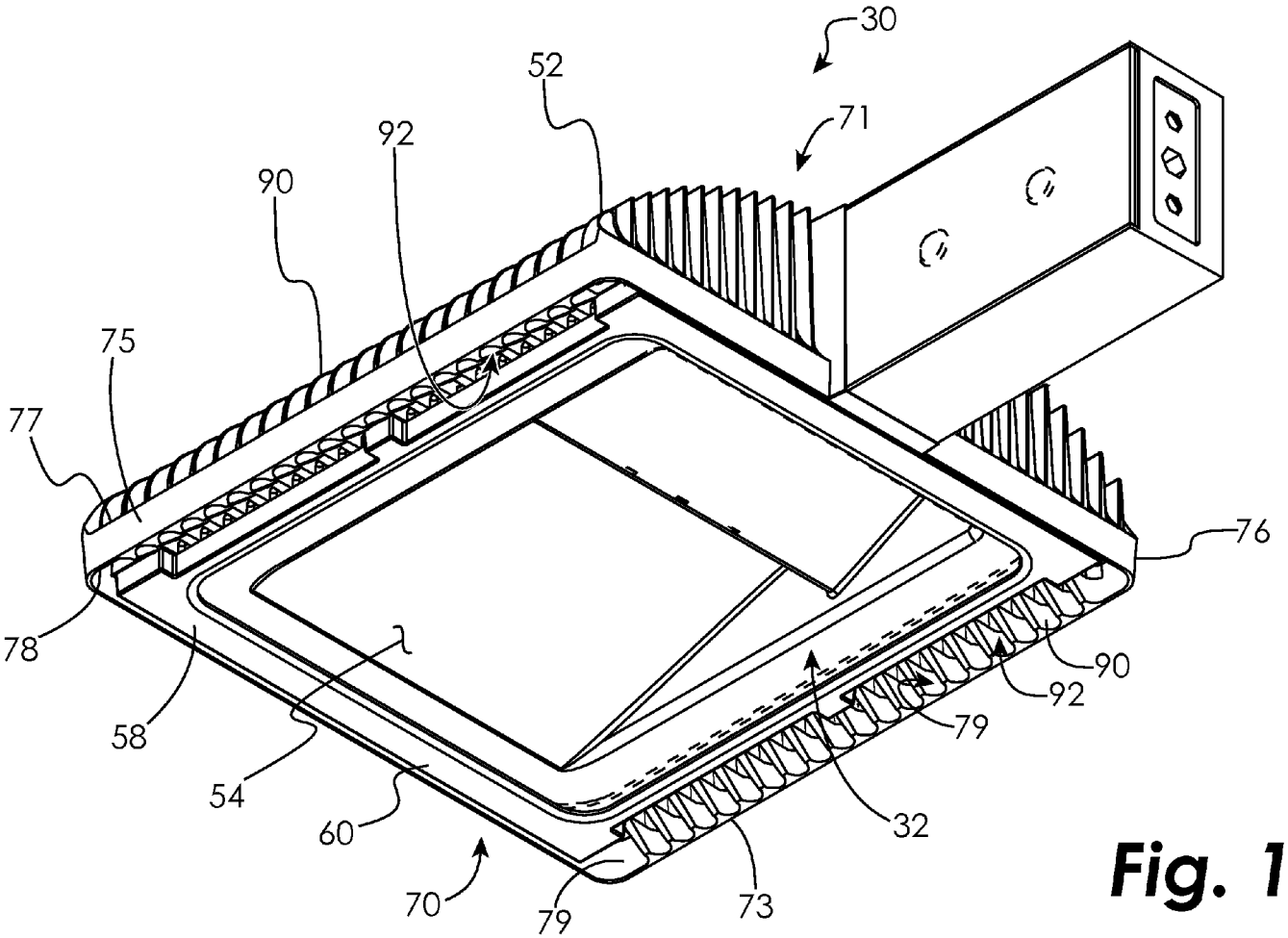
FIG. 1 is a bottom perspective view of a first illustrative lighting fixture according to the present invention.

For the purposes of promoting and understanding the principals of the invention, reference will now be made to one or more illustrative embodiments illustrated in the drawings and specific language will be used to describe the same.

Referring to FIGS. 1-4, a first illustrative embodiment of a light fixture 30 according to the present invention is illustrated. The light fixture 30 includes a light source 32, including an emitter 34 (FIG. 2; as used herein, "emitter" refers to a single emitter or an array of emitters) and a driver 36 (not shown; as used herein, "driver" refers to a single driver or an array of drivers), and an emitter housing 52. For example, light source 32 may be, but is not limited to, an LED emitter 34 and associated driver 36, as are typically used in the commercial lighting industry. For example, the associated driver 36 converts AC power to appropriate DC power and may also include additional LED power and control features.

The emitter housing 52 can be formed from, for example, die cast aluminum or an aluminum alloy. The emitter 34 can be thermally coupled and mounted to the emitter housing 52. As it typical of commercial lighting fixtures, the emitter housing 52 may also include components that enclose the emitter 34 within emitter housing 52, for example, including a light reflector 54, lens 58, and frame 60. In the first illustrative embodiment of the light fixture 30, the driver 36 (not shown) is also located within the emitter housing 52.

Figure 2:
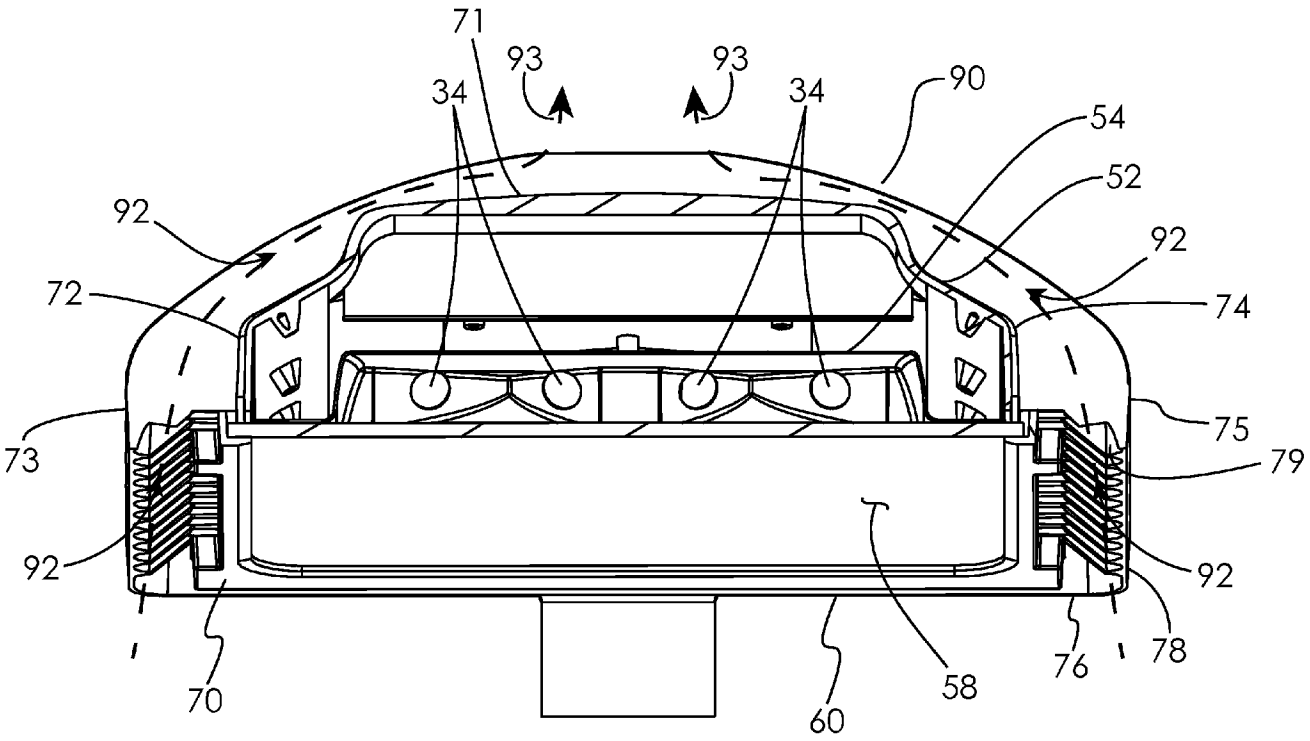
FIG. 2 is a front perspective cross-sectional view of the lighting fixture of FIG. 1, taken along section line 2-2 shown in FIGS. 3 and 4.
Figure 3:
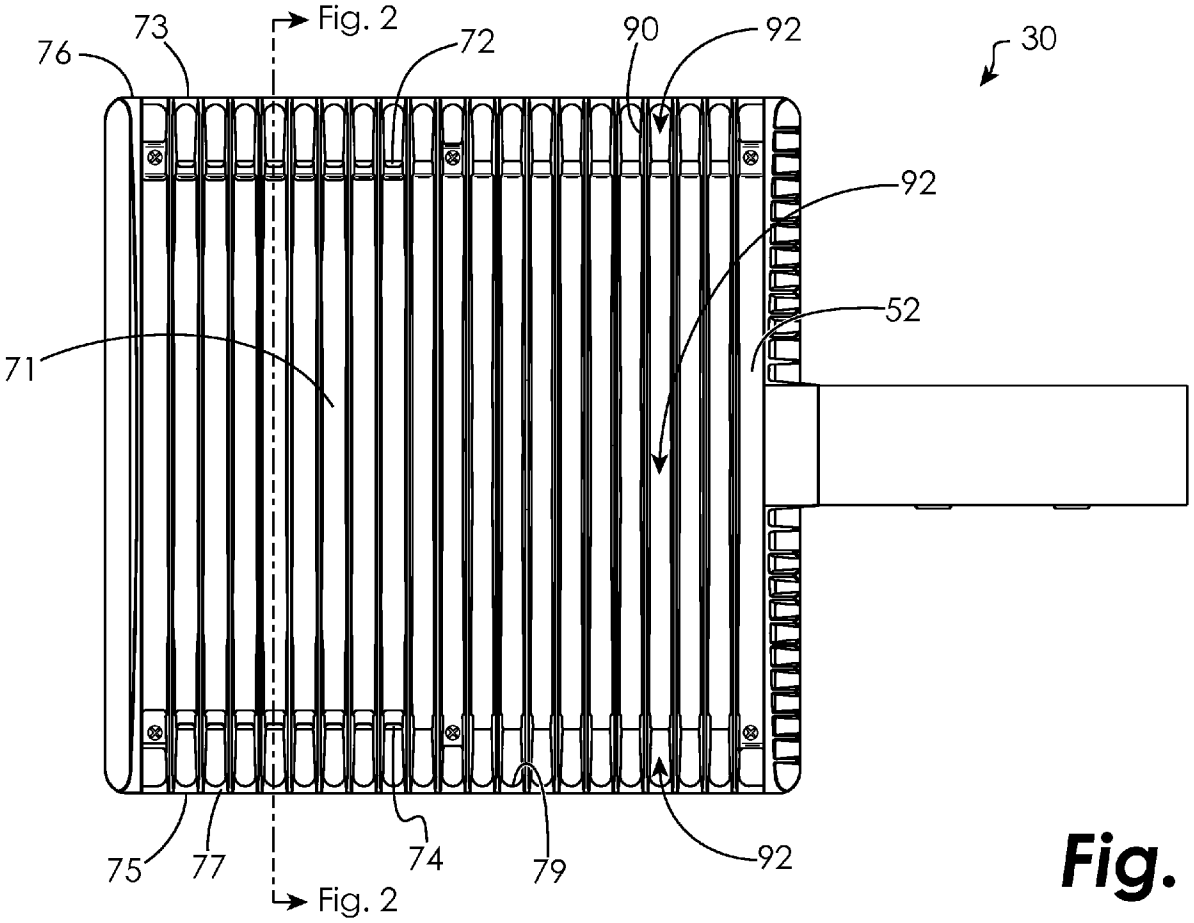
FIG. 3 is a top view of the lighting fixture of FIG. 1.
Figure 4:
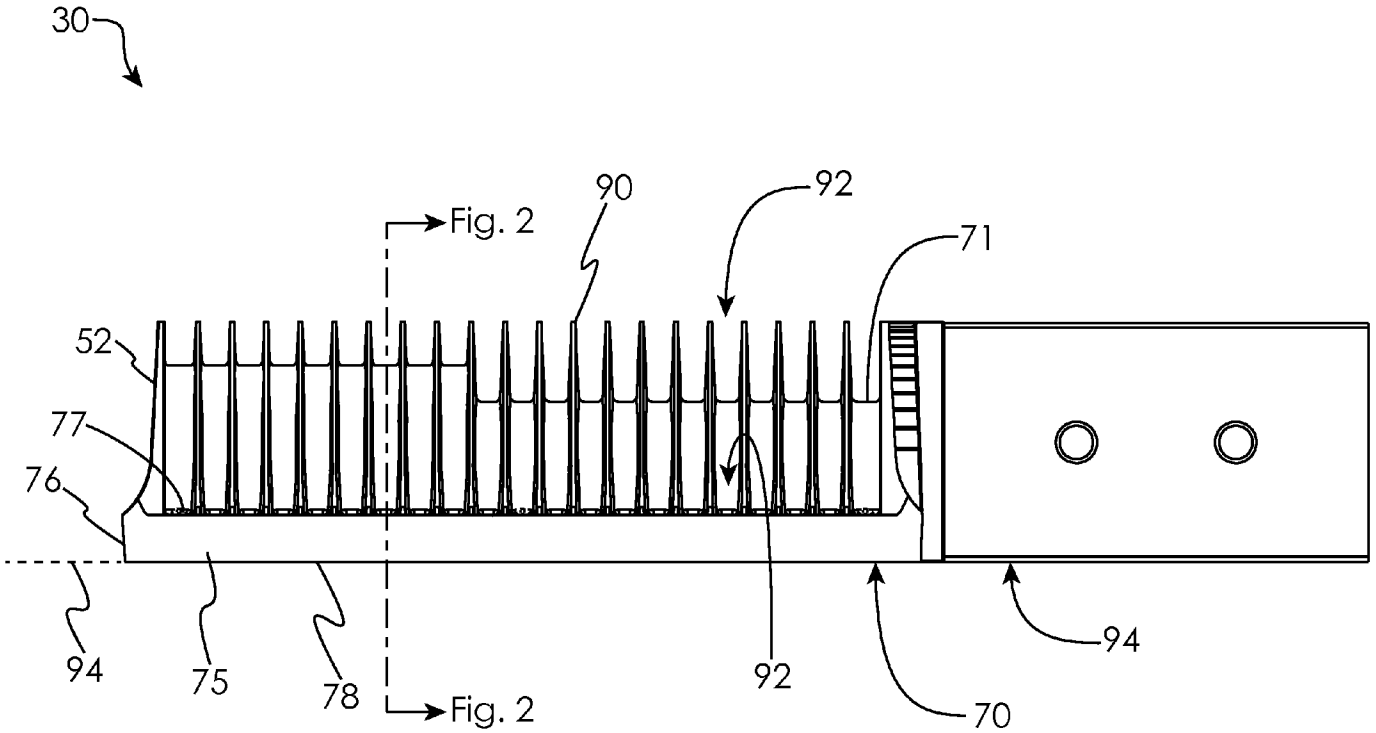
FIG. 4 is a side view of the lighting fixture of FIG. 1.

Referring to FIGS. 2, 3, and 4, the emitter housing 52 defines an illumination side 70 from which the light source 32 projects light (for example, in the first embodiment defined by the frame 60 and lens 58), an opposite surface or back side 71, a left side edge 72, and a right side edge 74. The light fixture 30 also includes a rim 76 around the periphery of the light housing 52, including a left rim 73, a right rim 75, a top rim edge 77, a bottom rim edge 78, and an interior surface 79. In the first illustrative embodiment, the left rim 73 is spaced apart from the left side edge 72 of the housing 52, the right rim 75 is spaced apart from the right side edge 74, and the remainder of the rim 76 on front and rear sides contacts the housing 52.

The light fixture 30 also includes a plurality of fins 90, for example, in the first embodiment defined at least in part by the back side 71 of the emitter housing 52, thus, the plurality of fins 90 are in thermal conductivity with the emitters 34 and dissipate heat from the emitters to the surrounding environment.

Referring to FIGS. 2 and 3, in the first illustrative embodiment of the light fixture 30, airflow cooling channels 92 are defined by the space between opposite side edges 72 and 74 of the emitter housing 52 and the opposite sides of the rim 73 and 75, and each adjacent fin 90. The cooling channels 92 extend vertically from the bottom rim edge 78 to the top rim edge 77 and allow air to flow between the illumination side 70 and the back side 71, for example, typically heating of the housing 52 would draw air from the illumination side to the back side 71. Optionally, the fins 90 and associated channels 92 can be parallel, and/or evenly spaced, as shown in FIG. 3.

Additionally, as shown in FIGS. 2-4, in the first embodiment of the light fixture 30, the airflow cooling channels 92 spanning between the opposite rims 73 and 75 and edges 72 and 74 (FIG. 2), specifically spanning across a back side 71 of the housing between adjacent fins 90, allowing airflow 93 (FIG. 2) to travel upward from the illumination side 70 of each side 72 and 74 and across the back side 71. If the light fixture 30 is mounted to illuminate upward, for example, against a ceiling (not shown), mounted with the back side 71 facing downward and the illumination side 70 upward, then the direction of airflow 93 would typically be reversed.

Advantageously, the rims 73 and 75 provide the added functionality of providing support to the fins 90 where they extend beyond the left and right side edges 72 and 74 of the emitter housing 52, more surface area for convective and radiant heat transfer to the surrounding air, and providing a more aesthetically appealing appearance of the light fixture 30, limiting the spiny look while retaining the needed cooling fins 90 projecting beyond the housing 52 by providing the rim 76. For example, the rims 73 and 75 conceal portions of the light fixture 30 because the side edges 72 and 74 of the housing 52 and the fins 90 do not extend below (in the direction of the illumination side 70) an plane 94 (FIG. 4) formed by the bottom edges 78 of the rims 73 and 74.

Figure 5:
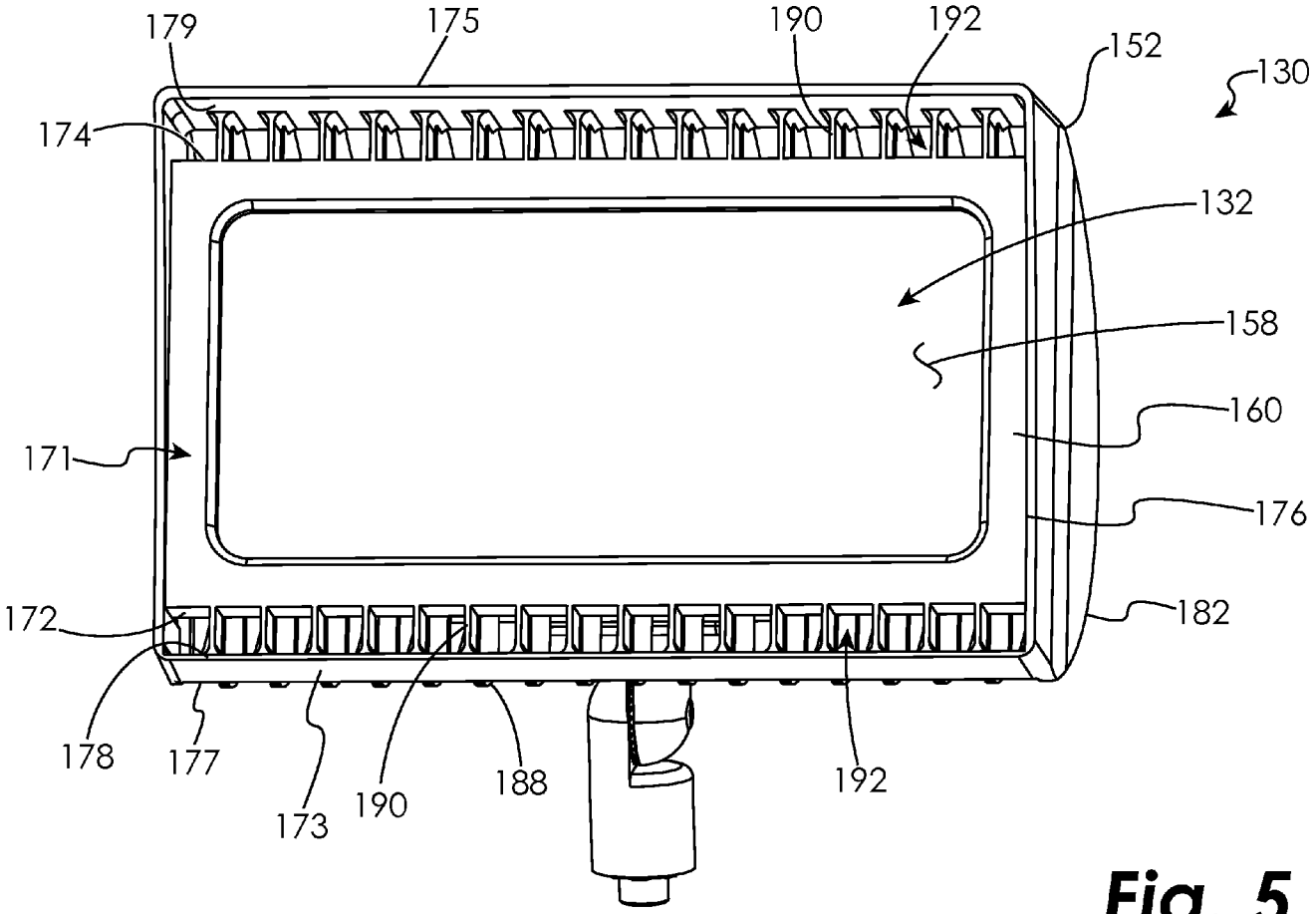
FIG. 5 is a front view perspective view of a second illustrative lighting fixture according to the present invention.
Figure 6:
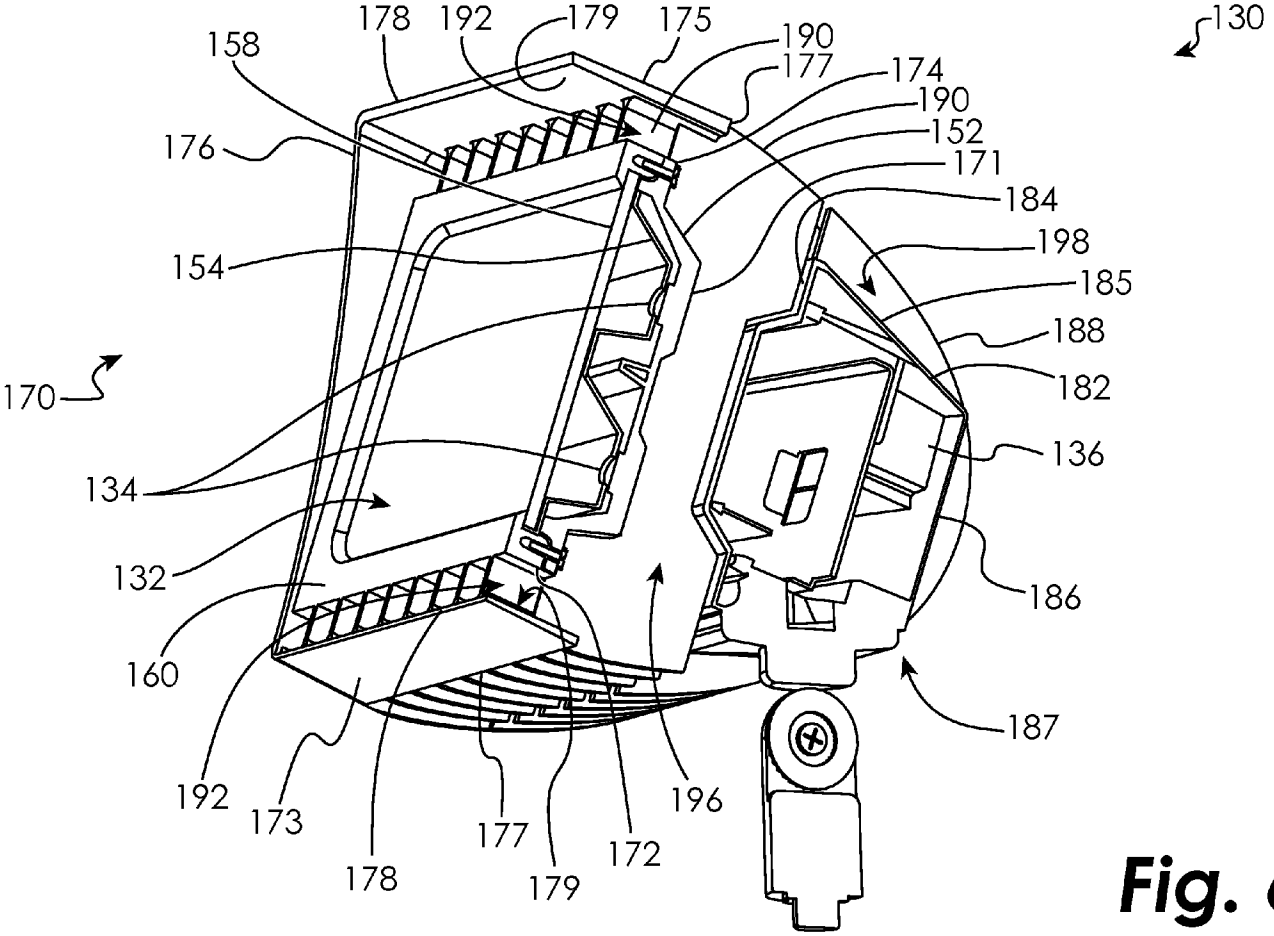
FIG. 6 is a side perspective cross-sectional view of the lighting fixture of FIG. 5, taken along section line 6-6 shown in FIG. 7.
Figure 7:
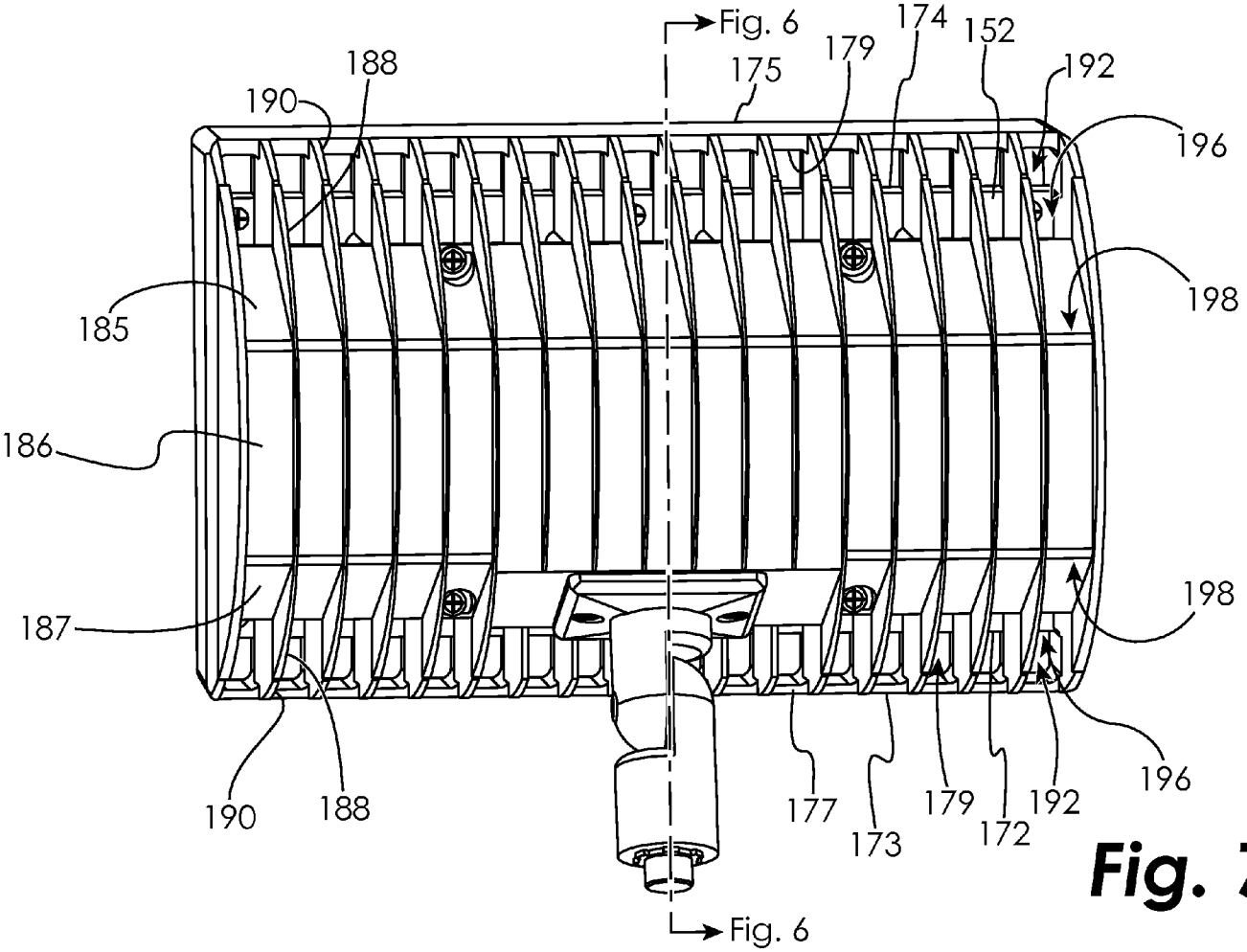
FIG. 7 is a rear perspective view of the lighting fixture of FIG. 5.

Referring to FIGS. 5-7, a second illustrative embodiment of a light fixture 130 according to the present invention is illustrated. The features described above for the first embodiment of the light fixture 30 may also be selectively incorporated in the light fixture 130.

Referring to FIG. 6, the light fixture 130 includes a light source 132, including an emitter 134 and a driver 136, an emitter housing 152, and a driver housing 182. The emitter housing 152 and driver housing 182 can be formed from, for example, die cast aluminum or an aluminum alloy. The emitter 134 can be thermally coupled and mounted to the emitter housing 152, and the driver 136 can be thermally coupled and mounted to the driver housing 182. As it typical of commercial lighting fixtures, the emitter housing 152 may also include components that enclose the emitter 134 within emitter housing 152, for example, including a light reflector 154, lens 158, and frame 160.

The emitter housing 152 defines an illumination side 170 (FIG. 6) from which the light source 132 projects light, an opposite surface or back side 171, a bottom side edge 172, and a top side edge 174. The light fixture 130 also includes a rim 176 around the periphery of the emitter housing 152, including a bottom rim 173, a top rim 175, a rear rim edge 177, a front rim edge 178, and an interior surface 179. In the second illustrative embodiment, the bottom rim 173 is spaced apart from the bottom side edge 172 of the housing 152, the top rim 175 is spaced apart from the top side edge 174, and the remainder of the rim 176 on left and right sides contacts the housing 152.

The light fixture 130 also includes a plurality of emitter fins 190, for example, in the first embodiment defined by the back side 171 of the emitter housing 152, thus, the plurality of emitter fins 190 are in thermal conductivity with the emitters 134 and dissipate heat from the emitters to the surrounding environment.

The driver housing 182 defines surfaces including a front side 184, which faces the back side 171 of the emitter housing 152, a top side 185, a rear side 186, and a bottom side 187. Referring to FIGS. 6 and 7, a plurality of driver fins 188 are defined by the driver housing 182 and span from the intersection of the front side 184 and top side 185, across the rear side 186, to the intersection of the front side 184 and the bottom side 187. The plurality of driver fins 188 are in thermal conductivity with the driver 136 and dissipate heat from the driver to the surrounding environment. Each of the driver fins 188 can be coplanar with respective ones of the emitter fins 190, as is shown most clearly in FIG. 7. Referring to FIG. 6, a space 196 is defined between the rear side 171 of the emitter housing 152, and the front side 184 of the driver housing 182, and will be further referenced below.

As with the first illustrative embodiment, in the second illustrative embodiment of the light fixture 130, airflow cooling channels 192 are defined by the space between opposite side edges 172 and 174 of the emitter housing 152 and the opposite sides of the rim 173 and 175, and each adjacent fin 190. The cooling channels 192 extend from the front rim edge 178 to the rear rim edge 177 and allow air to flow between the illumination side 170 and the back side 171. Optionally, the fins 190 can be parallel, and/or evenly spaced, as shown in FIG. 7.

Additionally, as shown in FIG. 6, in the second embodiment of the light fixture 130, the airflow cooling channels 192 span between fins 190 through the space 196. Specifically, the cooling channels 192 span between the opposite rims 173 and 175 and edges 172 and 174, between and across a back side 171 of the emitter housing 152 and front side 184 of the driver housing 182.

Additionally, as shown in FIGS. 6 and 7, the airflow from cooling channels 192 can flow not only through the space 196, but around the driver housing 186 in the channels 198 defined by adjacent driver fins 188. The channels 198 can extend fully around the driver housing 186, from the intersection of the front side 184 and top side 185, across the back side 186, and to the intersection of the front side 184 and the bottom side 187.

While the invention has been illustrated and described in detail in the foregoing drawings and description, the same is to be considered as illustrative and not restrictive in character, it being understood that only illustrative embodiments thereof have been shown and described and that all changes and modifications that come within the spirit and scope of the invention as defined in the claims and summary are desired to be protected.

The invention claimed is:

1. A light fixture for a light emitter, comprising:

an emitter housing;

an illumination side of the emitter housing, the light emitter projecting light from the illumination side;

an opposite side of the emitter housing, located opposite the illumination side;

a first and second edge defined by the emitter housing, each of the first and second edges spanning between the illumination and opposite sides;

a first rim positioned along the first edge of the emitter housing and spanning between the illumination and opposite sides;

a second rim positioned along the second edge of the emitter housing and spanning between the illumination and opposite sides; and a first plurality of fins spanning between the first edge and the first rim, the first edge and the second edge, the second edge and the second rim, and the first rim and the second rim.

2. The light fixture of claim 1, further comprising a plurality of airflow channels, each of the plurality of airflow channels defined between adjacent ones of the first plurality of fins, each of the plurality of airflow channels open to the illumination side of the emitter housing between the first rim and the first edge, extending across the opposite side of the emitter housing, and open to the illumination side of the emitter housing between the second rim and the second edge.

3. The light fixture of claim 1, further comprising:

a driver housing, the driver housing defining a front surface; and an airflow passage defined by a space between the opposite side of the emitter housing and the front surface of the driver housing; and wherein the first plurality of fins extend through the airflow passage.

4. The light fixture of claim 3, further comprising a second plurality of fins defined by the driver housing.

5. The light fixture of claim 4, wherein the first plurality of fins and the second plurality of fins form a plurality of coplanar fins surfaces.

6. The light fixture of claim 1, wherein a plane formed across the first rim and the second rim is not intersected by the first plurality of fins.

7. The light fixture of claim 1, wherein a plane formed across the first rim and the second rim is not intersected by the first edge or the second edge.

8. The light fixture of claim 1, wherein the first plurality of fins are in thermal conductivity with the light emitter.

9. The light fixture of claim 1, wherein the first rim and the second rim are on opposite sides of the emitter housing.

10. The light fixture of claim 1, wherein the first plurality of fins are parallel with one another.

11. The light fixture of claim 1, wherein the first plurality of fins are evenly spaced.

12. The light fixture of claim 1, further comprising a top surface defined by the emitter housing, and wherein the top edges of the first plurality of fins are coplanar with the top surface of the emitter housing.

13. A light fixture for a light emitter, comprising:

an emitter housing;

an illumination side of the emitter housing, the light emitter projecting light from the illumination side;

an opposite side of the emitter housing, located opposite the illumination side;

a first and second edge defined by the emitter housing between the illumination and opposite sides;

a first rim positioned along the first edge of the emitter housing;

a second rim positioned along the second edge of the emitter housing; and a first plurality of fins spanning between the first edge and the first rim, across the opposite side of the emitter housing, and between the second edge and the second rim.

14. The light fixture of claim 13, further comprising:

a driver housing, the driver housing defining a front surface; and an airflow passage defined by a space between the opposite side of the emitter housing and the front surface of the driver housing; and wherein the first plurality of fins extend through the airflow passage.

15. The light fixture of claim 14, further comprising a second plurality of fins defined by the driver housing.

16. The light fixture of claim 15, wherein the first plurality of fins and the second plurality of fins form a plurality of coplanar fins surfaces.

17. A light fixture for a light emitter, comprising:

a first housing;

an illumination side of the first housing, the light emitter projecting light from the illumination side;

an opposite side of the first housing, located opposite the illumination side;

a first and second edge defined by the first housing between the illumination and opposite sides;

a rim extending around at least two opposite edges of the first housing;

a first plurality of fins spanning between the rim and the at least two opposite edges of the housing and across the opposite side of the first housing; and a plurality of airflow channels, each of the plurality of airflow channels defined between adjacent ones of the first plurality of fins, each of the plurality of airflow channels open to the illumination side of the first housing between the rim and a first one of the at least two opposite edges of the first housing, extending across the opposite side of the first housing, and open to the illumination side of the housing between the rim and a second one of the at least two opposite edges of the first housing.

18. The light fixture of claim 17, further comprising:

a second housing, the second housing defining a front surface; and an airflow passage defined by a space between the opposite side of the first housing and the front surface of the second housing; and wherein the first plurality of fins extend through the airflow passage.

19. The light fixture of claim 18, further comprising a second plurality of fins defined by the second housing.

20. The light fixture of claim 19, wherein the first plurality of fins and the second plurality of fins form a plurality of coplanar fins surfaces.

* * * * *